United States Patent [19]

Kusuda et al.

[11] Patent Number: 4,884,096

[45] Date of Patent: Nov. 28, 1989

[54] MULTIPLE COLOR IMAGE FORMING APPARATUS

[75] Inventors: Yasuhiro Kusuda; Takafumi Tottori, both of Osaka, Japan

[73] Assignee: Minolta Camera Kabushiki Kaisha, Osaka, Japan

[21] Appl. No.: 218,155

[22] Filed: Jul. 13, 1988

[30] Foreign Application Priority Data

Jul. 15, 1987 [JP] Japan ..... 62-176559

[51] Int. Cl.[4] ..... G03G 15/01

[52] U.S. Cl. ..... 355/233; 355/326; 355/328

[58] Field of Search ..... 355/14 D, 7, 4, 14 R, 355/3 DD, 8

[56] References Cited

U.S. PATENT DOCUMENTS

| | | | |
|---|---|---|---|
| 2,910,963 | 11/1959 | Herman | 118/657 |
| 3,572,288 | 6/1968 | Turner | 118/637 |
| 3,914,043 | 10/1975 | McVeigh | 355/4 |
| 3,960,445 | 6/1976 | Drawe | 355/4 |
| 3,967,891 | 7/1976 | Rippstein | 355/3 R |
| 4,099,860 | 7/1978 | Connin | 355/14 |
| 4,346,982 | 8/1982 | Nakajima et al. | 355/3 R |
| 4,373,798 | 2/1983 | Tsukada et al. | 355/3 DD |
| 4,572,102 | 2/1986 | Yuge et al. | 118/689 |
| 4,579,443 | 4/1986 | Abuyama et al. | 355/14 R |
| 4,619,514 | 10/1986 | Ide | 355/3 R |
| 4,627,707 | 12/1986 | Tani et al. | 355/14 R |
| 4,634,259 | 1/1987 | Oishi et al. . | |
| 4,641,602 | 2/1987 | Kasai | 118/653 |
| 4,657,376 | 4/1987 | Ide | 355/14 R |
| 4,659,211 | 4/1987 | Oka | 355/14 D |
| 4,666,288 | 5/1987 | Watanabe | 355/14 R |
| 4,685,794 | 8/1987 | Watanabe | 355/7 |
| 4,690,543 | 9/1987 | Watanabe | 355/4 |
| 4,710,016 | 12/1987 | Watanabe | 355/4 |
| 4,720,730 | 1/1988 | Ito | 355/4 |
| 4,723,148 | 2/1988 | Hamakawa | 355/14 SH |
| 4,728,985 | 3/1988 | Nakashima et al. | 355/7 |
| 4,740,811 | 4/1988 | Watanabe | 355/61 |
| 4,743,945 | 5/1988 | Ito et al. | 355/14 SH |
| 4,743,946 | 5/1988 | Nishimori et al. | 355/14 C |
| 4,745,437 | 5/1988 | Oka et al. | 355/14 CH |
| 4,746,954 | 5/1988 | Matuura et al. | 355/14 D |
| 4,754,301 | 6/1988 | Kasamura et al. | 355/3 DD |
| 4,772,921 | 9/1988 | Ito | 355/14 SH |
| 4,814,823 | 3/1989 | Abuyama et al. | 355/14 D |

FOREIGN PATENT DOCUMENTS

| | | |
|---|---|---|
| 3705511 | 9/1987 | Fed. Rep. of Germany . |
| 48-22212 | 7/1973 | Japan . |
| 51-134635 | 11/1976 | Japan . |
| 54-30833 | 3/1979 | Japan . |
| 60-170868 | 9/1985 | Japan . |
| 60-212778 | 10/1985 | Japan . |
| 61-72270 | 4/1986 | Japan . |
| 61-203474 | 9/1986 | Japan . |

*Primary Examiner*—R. L. Moses

*Attorney, Agent, or Firm*—Burns, Doane, Swecker & Mathis

[57] ABSTRACT

A multiple color image forming apparatus using a plurality of developing devices selectively during one image forming process to reproduce a plurality of designated areas respectively in designated color, whereby color mixing and non-developing of the reproduced image can be freely performed by setting the start and end points of the designated area responsive to a plurality of the developing devices and controlling them in response to such setting.

14 Claims, 12 Drawing Sheets

MULTIPLE COLOR IMAGE FORMING APPARATUS

BACKGROUND OF THE INVENTION

1. Field of the Invention

The present invention relates to a multiple color image forming apparatus for reproducing an original image in a plurality of colors, more particularly, it relates to a multiple color image forming apparatus which selects the image for color mixing or non-developing.

2. Description of the Prior Art

Conventionally, a multiple color copying machine has been provided for reproducing an original in a plurality of colors by arranging a plurality of developing device into which developers of different colors are contained around a photosensitive drum, and performing a series of image forming processes such as charging, exposing, partial erasing, developing, transferring and fixing twice successively.

However, in such multiple color copying machine, a special paper feed passage and feed means for guiding a copying paper which has completed the first image forming process to the second image forming process are required, thus resulting in a large apparatus and complicated construction. Also, since the image forming process has to be passed twice, during which the copying paper is exposed to many mechanical and thermal stresses to cause rumples and curls, and results in a positional shift of image and blocking of paper.

SUMMARY OF THE INVENTION

The present invention has been devised to solve the aforesaid prior art problems, therefore, it is an object of the present invention to provide a multiple color image forming apparatus, whereby a plurality of designated areas of an image are reproduced respectively in designated colors by selectively using a plurality of developing devices during one image forming process.

It is another object of the present invention to provide a multiple color image forming apparatus, whereby color mixing or non-developing of the reproduced image can be performed optionally by setting start and end points of the designated areas respectively responsive to a plurality of developing devices and controlling thereof.

The above and further objects and features of the present invention will more fully be apparent from the following detailed description with accompanying drawings.

DESCRIPTION OF THE PREFERRED EMBODIMENTS

Now, the present invention will be explained with reference to the accompanying drawings showing an embodiment.

Figure 1:
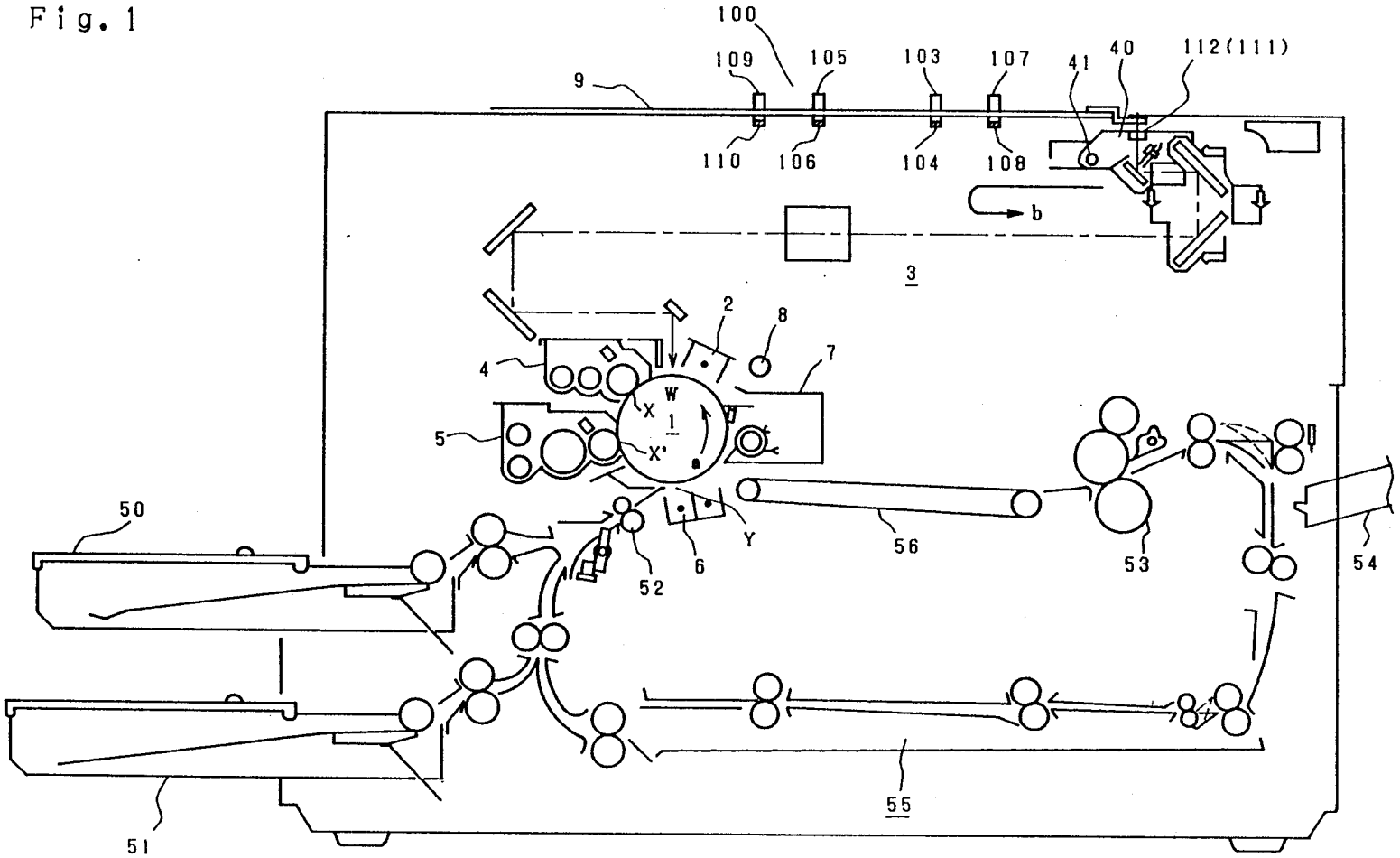
FIG. 1 is a schematic sectional view of one embodiment of a multiple color image forming apparatus according to the present invention.

FIG. 1 is a schematic sectional view of a two-color copying machine as a multiple color image forming apparatus. The schematic construction will be explained together with a standard copying operation for reproducing an original image as it is.

First, in the state where a photosensitive drum 1 is rotating in a direction indicated by an arrow "a", a constant charge is applied on the surface of the photosensitive drum 1 by discharging a charger 2.

Next, an electrostatic latent image responsive to an original image is formed in such a manner that, as a scanner 40 of an optical system 3 scans in a direction indicated by an arrow "b", light is irradiated to an original placed on an original table glass 9 from an exposure lamp 41, and the reflected light is exposed on the surface of photosensitive drum 1 from an exposure point W through mirrors and lenses.

The electrostatic latent image is developed into a real image by receiving a toner at a following developing area X or X' opposing a first developing device 4 or second developing device 5, and a toner image is formed to reproduce the original image.

While, a copying paper is selectively fed from a paper feeder 50 or 51, and conveyed to a transferring area Y opposing a transfer charger 6 in synchronism with the toner image on the photosensitive drum 1 by a pair of timing rollers 52. After said toner image is transferred thereat, the copying paper is conveyed between a pair of fixing rollers 53 by a conveying belt 56 and the toner image is fused and fixed thereon by the fixing rollers 53. Then the copying paper is discharged to a discharge tray 54. However, when a duplex copying mode or composite copying mode has been selected, the copying paper is sent to a duplex unit 55. In the case of duplex copying mode, the copying paper is reversed in the unit 55 and returned to the transferring area Y where the image is formed on the reverse side. In the case of composite copying mode, a further image is superposed on the image formed in the foregoing image forming operation.

Meanwhile, the surface of the photosensitive drum 1 is cleaned by a cleaning device 7 to scrape off the residual toner, and additionally irradiated with light of an eraser lamp 8 to erase the residual charge for the next developing.

The copying machine qualified for the aforesaid operations is possible, in addition to the standard copying, duplex copying and composite copying function previously described, to execute operation for obtaining a two-color composite copy by scanning the scanner 40 once, (hereinafter referred to as "1-scan 2-color copy"), therefore, besides providing an image editing mechanism 100, special mechanisms are disposed on the developing devices 4, 5 respectively.

First, the construction of developing devices 4, 5 will be explained.

Figure 2:
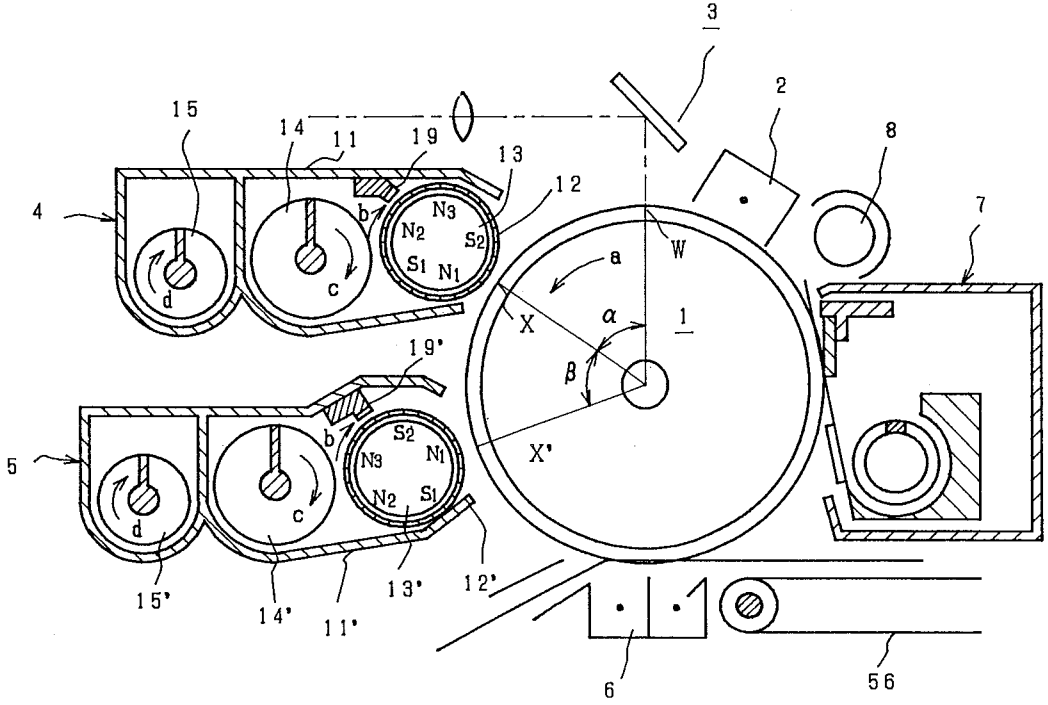
FIG. 2 is an enlarged sectional view showing the configuration of a photosensitive drum and its peripheral equipments.
Figure 3:
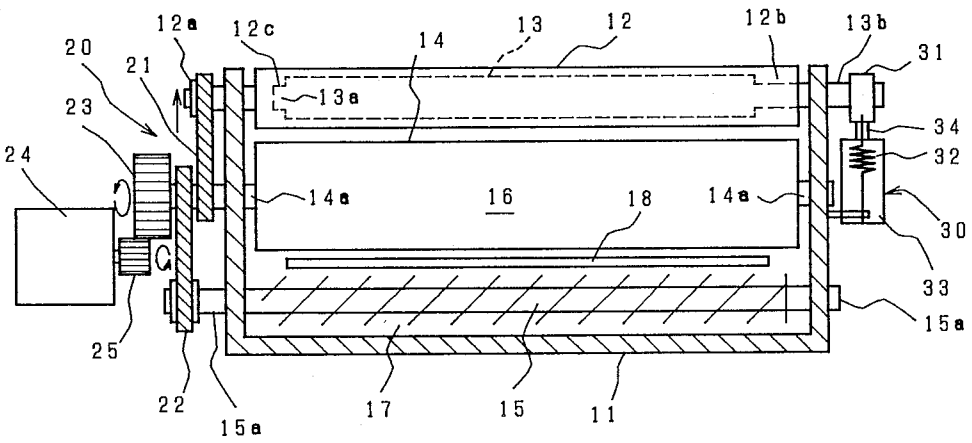
FIG. 3 is a transverse sectional view of a first developing device.
Figure 4:
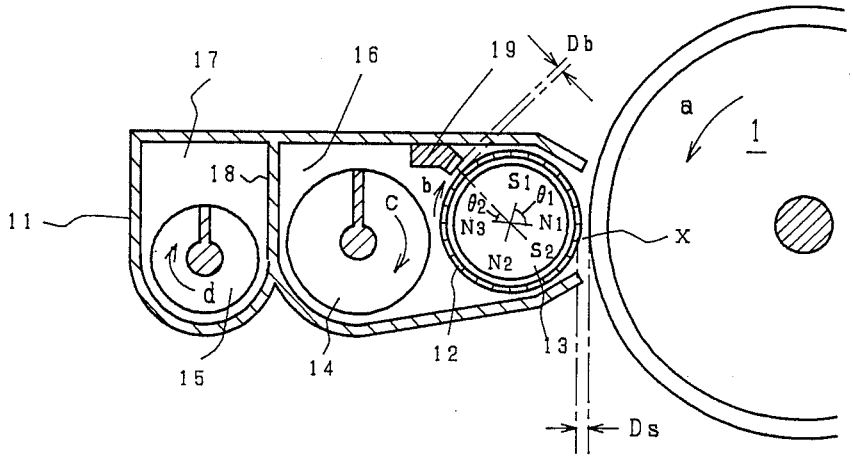
FIG. 4 and FIG. 6 are longitudinal sectional views showing respective operations of a first developing device at developing and non-developing.
Figure 5:
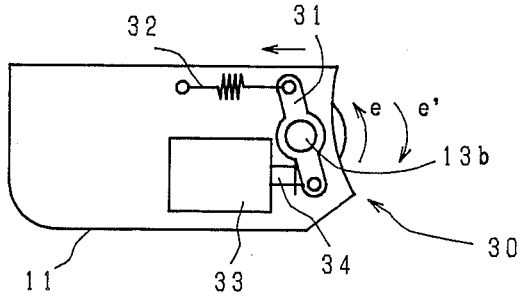
FIG. 5 and FIG. 7 are side views showing respective operations of a moving means at developing ad non-developing.
Figure 6:
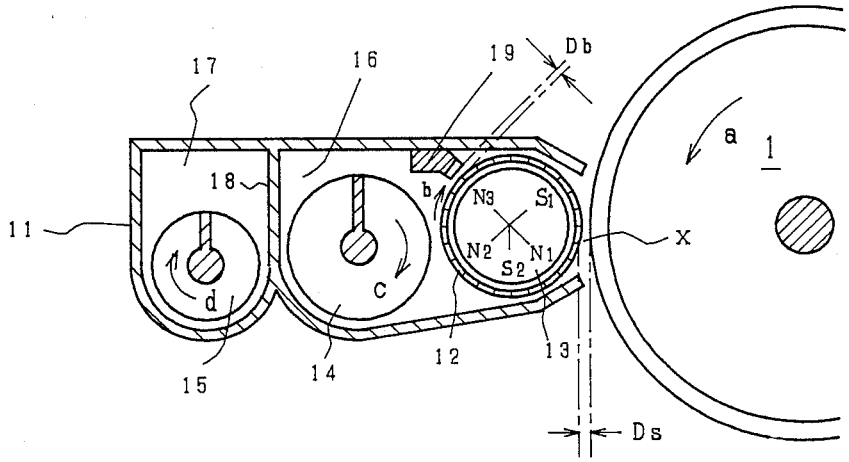
Figure 7:
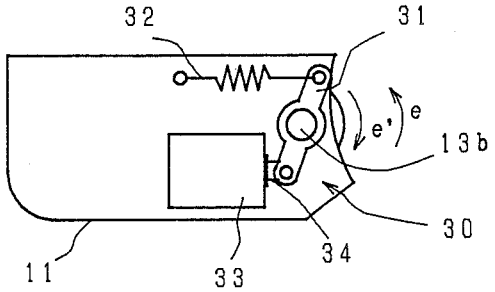

FIG. 2 is an enlarged sectional view showing the configuration of a photosensitive drum and its peripheral equipments, FIG. 3 is a transverse sectional view of a first developing device, FIGS. 4 and 6 are longitudinal sectional views showing respective operations of the first developing device at developing and non-developing, and FIGS. 5 and 7 are side views showing respective operations of a moving means at developing and non-developing.

The first developing device 4 and second developing device 5 are substantially the same construction as shown in FIG. 2, so that only the first developing device will be explained in the following explanation and the second developing device will be omitted. In a developing tank 11, a developing sleeve 12, supply roller 14 and screw 15 are disposed in order from the side of the photosensitive drum 1, in the first developing device 4 a developer consisting of a magnetic carrier and insulated color toner is contained and in the second developing device 5, a developer consisting of the magnetic carrier and usually used insulated block toner is contained.

The developing sleeve 12 and 12' comprising a non-magnetic conductive material formed cylindrically ($\phi$24.5 mm) with an uneven surface formed finely by sand blasting are respectively opposed to the developing areas X and X' at a developing gap: Ds (=0.6 mm) between the phonosensitive drum 1 and the developing sleeves. The angles of rotation from the exposure point W to the developing areas X, X' are respectively set at $\alpha$ and $\alpha+\beta$, where $\alpha$ is 56° and $\beta$ is 52°.

The back side of the developing area X of the developing sleeve 12 is opposed to a developer height restricting member 19 disposed at the inner upper portion of the developing tank 11 at a developer height restricting Gap:Db (=0.4 mm).

Within the developing sleeve 12, a magnet roller 13 provided with a number of magnets axially is disposed, and magnetic forces of magnetic poles ($N_1$ to $N_3$, $S_1$, $S_2$) located at the periphery of the magnets are set respectively at $N_1$=1000 G, $N_3$=500 G, $S_1$, $S_2$=800 G, where G is an abbreviation of gauss.

As show in FIG. 4, the center of said magnetic pole $N_1$ is arranged at $\theta_1$ (80° ) clockwise from that of the magnetic pole $S_1$, and the magnetic pole $N_3$ is arranged to locate its center at the place moved $\theta_2$ (40° ) counter-clockwise from the position opposing the developer height restricting member 19 when the magnetic pole $N_1$ is opposed to the photosensitive drum 1.

The magnet roller 13 is, as shown in FIG. 3, supported by a bearing cavity 12c provided in the developing sleeve 12 at one end 13a of its support shaft, and by a side wall of the developing tank 11 at the other end 13b thereof and rotatable by a prescribed angle (40° ) by the moving means 30 to be described hereinafter in detail.

While, the developing sleeve 12 is supported by the support shaft 13b of the magnet roller 13 at a right hand bearing 12b in FIG. 3 and by the side wall of the developing tank 11 at an opposite support shaft 12a so as to be rotated by a drive means 20.

The supply roller 14 and screw 15 are disposed respectively in conveying passages 16, 17 partitioned by a partition 18. These rollers 14, 15 are supported at the side wall of the developing tank 11 by their respective support shafts 14a, 15a, and rotated by the drive means 20.

The conveying passages 16, 17 are in communication with each other at each side of the developing tank 11 as shown in FIG. 3.

The driver means 20 for the developing devices 4, 5 supply roller 14 and screw 15 will be explained as follows.

As shown in FIG. 3 a belt 21 is installed on the support shaft 12a of the developing sleeve 12 and the support shaft 14a of the supply roller 14, whereas a belt 22 is installed on the support shaft 14a of the supply roller 14 and the support shaft 15a of the screw 15.

On the end of the support shaft 14a of the supply roller 14, there is provided a gear 23 which meshes with a drive gear 25 of a motor 24.

Accordingly, when the motor 24 is driven to rotate the drive gear 25 in the direction indicated by a full line shown in FIG. 3, the gear 23 and belts 21, 22 are adopted to rotate in the direction indicated by a full line, and the developing sleeve 12, supply roller 14 and screw 15 in the direction shown by the arrows "b", "c", "d". The developing sleeve 12 is designed to rotate at 240 rpm.

A moving means 30 of the magnet roller 13 comprises a lever 31, spring 32 and solenoid 33 as shown in FIGS. 5, 7. The lever 31 is fixed to the end of the support shaft 13b of the magnet roller 13 and to its one end the spring 32 secured to the developing tank 11 is mounted at one end and urged always in the direction indicated by an arrow "e". On the other end of the lever 31, a plunger 34 of the solenoid 33 is engaged to rotate the lever 31 in the direction indicated by an arrow "e'" against the urging force of the spring 32 when the solenoid 33 is driven.

When the solenoid 3 is not operated or the lever 31 is at the position shown in FIG. 5, as shown in FIG. 4, the magnetic pole $N_1$ of the magnet roller 13 is opposed to the photosensitive drum 1, and the magnetic pole $N_3$ is retreated to the position moved $\theta_2$ (40° ) counter-clockwise from the position opposing to the developer height restricting member 19.

Conversely, when the solenoid 33 is driven and the lever 31 is at the position shown in FIG. 7, as shown in FIG. 6, the magnetic pole $N_3$ is opposed to the developer height restricting member 19 and an intermediate portion between the magnetic poles $N_1$ and $S_1$ is brought to oppose to the photosensitive drum 1.

Next, the image editing mechanism 100 which designates and detects the image area of 1-scan 2-color copy will be explained.

Figure 8:
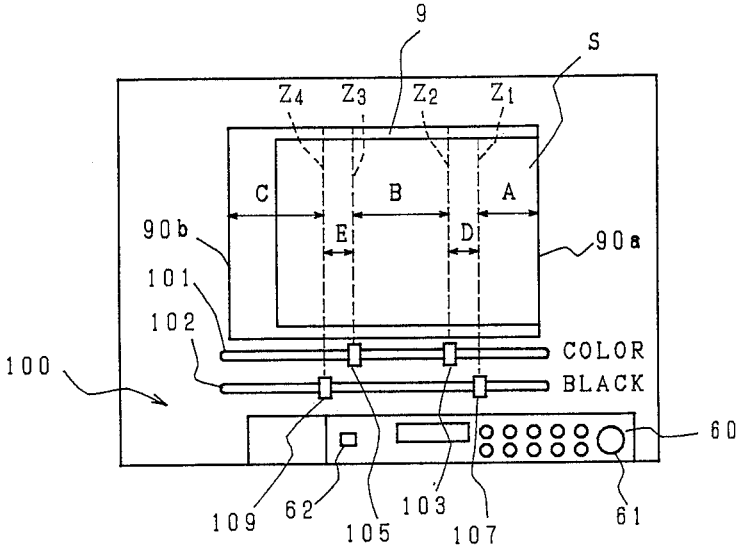
FIG. 8 is a plan view of a two-color copying machine showing an example of an image edition.

FIG. 8 is a plan view of a two-color copying machine showing an example of an image edition.

In FIG. 8, guide grooves 101, 102 of the image editing mechanism 100 are formed in front of the original table glass 9 in parallel thereto. The guide groove 101 is provided with a color-start lever 103 and color-end lever 105 movable along the groove, and the guide groove 102 with a black-end lever 107 and a black-start lever 109 respectively. The magnets 104, 106, 108, 110 are mounted respectively under each lever 103, 105, 107, 109 located in the copying machine body as shown in FIG. 1. While, on the scanner 40 in the optical system 3, a first reed switch 111 and second reed switch 112 are disposed. By scanning the scanner 40 in a direction indicated by an arrow "b", the first reed switch 111 detects the magnets 104, 106 and the second reed switch 112 detects the magnets 108, 110 to output signals respectively to the control unit 70 to be described later. For example, when the levers 103 to 109 are set as shown in FIG. 8, an area A between the front end 90*a* of the original table glass 9 and the black-end lever 107, and an area c between the black-start lever 109 and the rears end 90*b* of the original table glass 9 are designated as a black area. Under the same condition as mentioned above, an area B between the color-start lever 103 and the color-end lever 105 is designated as a color area. Also under the same condition, an area D between the black-end lever 107 and color-start lever 103 and an area E between the color-end lever 105 and black-start lever 109 are designated as a non-developing area.

In the control panel 60 of the copying machine shown in FIG. 8, the numeral 61 denotes a print switch and 62 indicates a 1-scan 2-color switch.

Next, operation of the control unit 70 when performing 1-scan 2-color copying will be explained with reference to FIG. 8 through FIG. 10.

An apostrophe ' is added to reference characters of the component part of the second developing device 5 for the sake of distinction.

Figure 10:
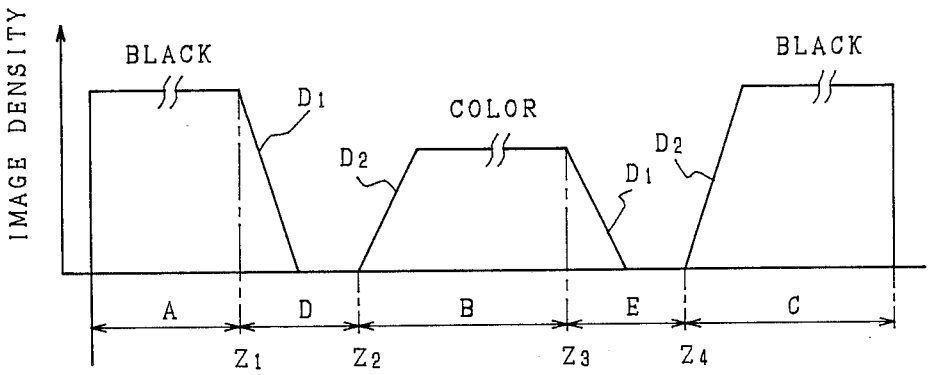
FIG. 10 is a graph showing the state of variation of an image density.
Figure 9:
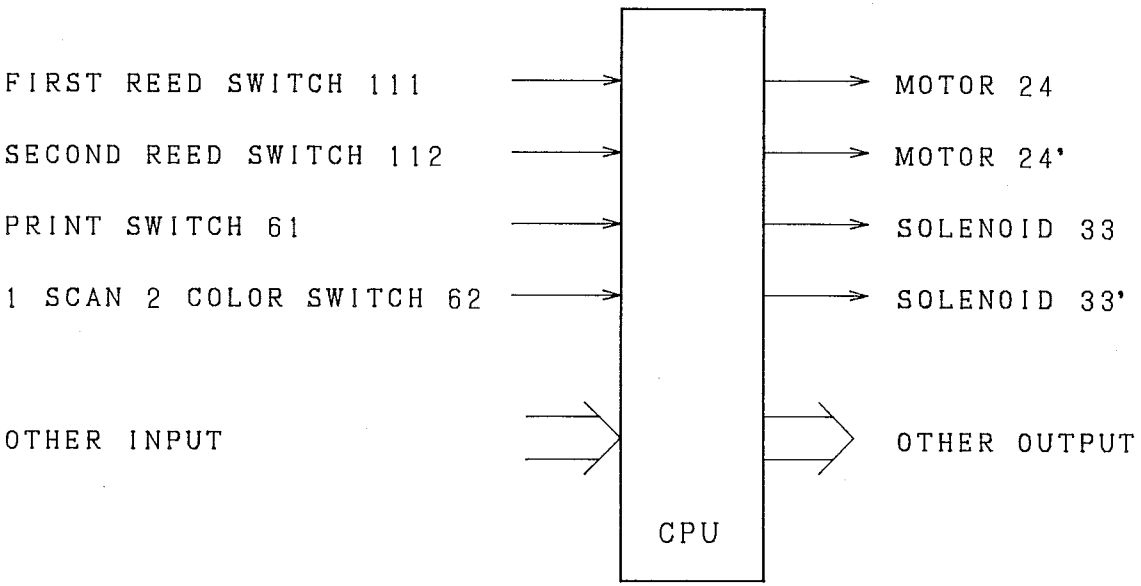
FIG. 9 is a block diagram showing the configuration of a control unit.

FIG. 9 is a block diagram showing the configuration of a control unit and FIG. 10 is a graph showing the state of variation of an image density, in which the image density is plotted along the ordinate and a scanning area along the abscissa. In FIG. 9, the numeral 70 indicates the control unit which comprises a microcomputer (hereinafter referred to as CPU), to which oututs from the first and second reed switches 111, 112, print switch 61, 1-scan 2-color switch 61, ten key and other input devices are given. The output from the control unit 70 is given to the first developing device motor 24, second developing device motor 24', first developing device solenoid 33, second developing device solenoid 33', display unit and other output devices.

First, when a main switch (not shown) of the copying machine is put on and the power is applied, the copying machine is set in the initial stage. Under the above condition, the first developing device 4 is set in the state shown in FIG. 6 and the intermediate portion between the magnetic poles $S_1$, $N_1$ is opposed to the photosensitive drum 1, whereas the second developing device 5 is set in the state shown in FIG. 4 and the magnetic pole $N_1$ is faced to the photosensitive drum 1.

When the print switch 61 is put on in this state, the second developing device 5 is automatically driven to start the aforesaid standard copying operation using the black toner. However when the 1-scan 2-color switch 62 is put on, a 1-scan 2-color mode described hereinafter is set. The 1-scan 2-color switch 62 can not be switched to the 1-scan 2-color mode even it is pressed during the copying operation.

Next, the levers 103, 105, 107, 109 are moved along the guide grooves 101, 102 to designate the color copying and black copying areas. The levers 103 to 109 are only effective when the 1-scan 2-color mode is selected, and it is so arranged that even the magnets 104 to 110 mounted to the levers 103 to 109 are detected by the first and second reed switches 111, 112 in the other modes, the copying operation is not affected by their signals.

Figure 11:
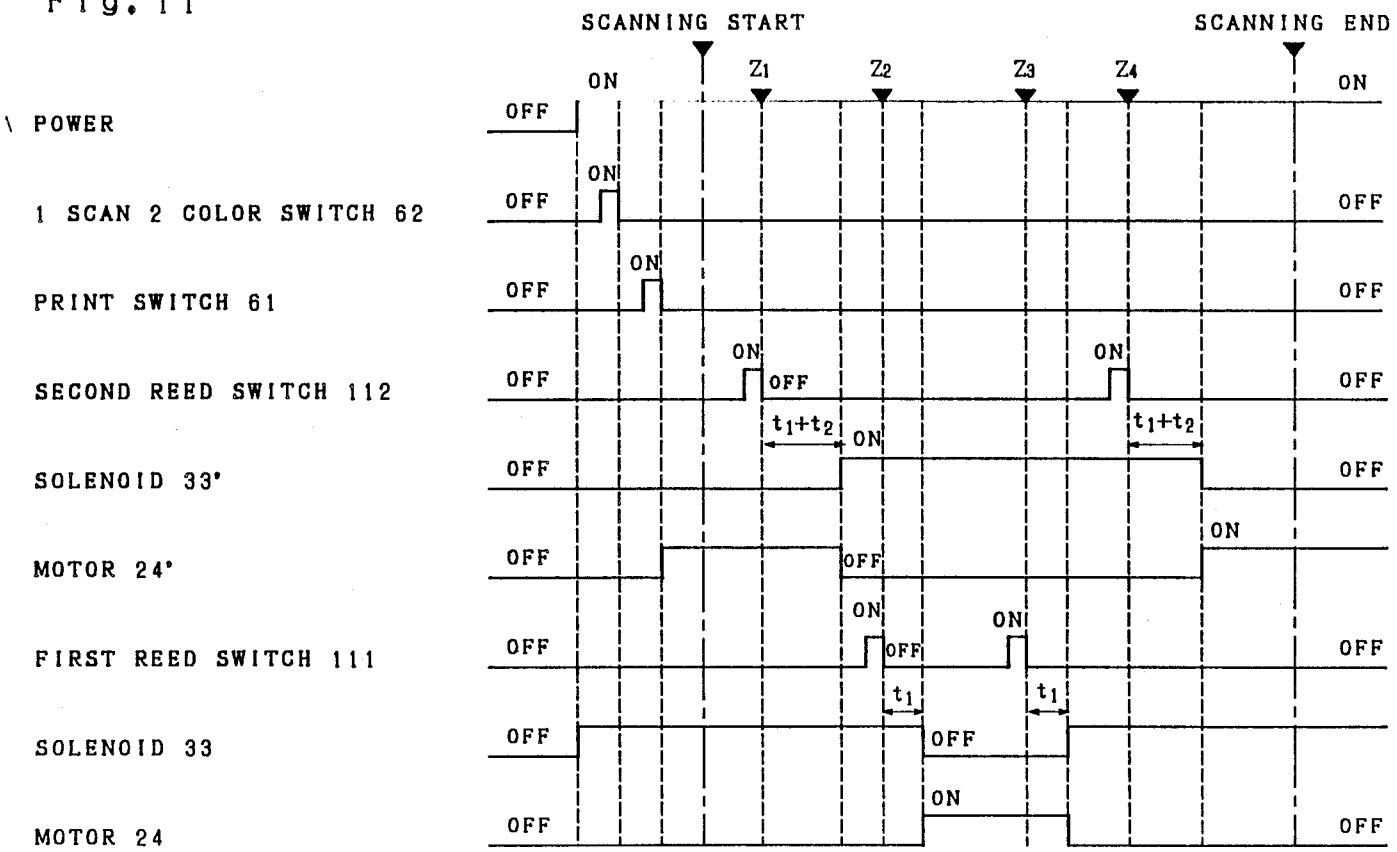
FIG. 11 is a timing chart showing control at a 1-scan 2-color mode.

FIG. 11 is a timing chart showing control at a 1-scan 2-color mode.

When the print switch 61 is on in the state where the levers 103 to 109 and the original S are set as shown in FIG. 8, the copying machine is operated according to the timing chart of FIG. 11.

First, when it is detected that the print switch 61 is pressed, the developing motor 24' of the second developing device 5 is started and in the second developing device 5, the developing sleeve 12', supply roller 14' and screw 15' are rotated respectively in the direction shown by arrows "b", "c", "d".

Thereby, the developer, which is contained in the developing tank 11' and includes the black toner, is circulated and conveyed through conveying passages 16', 17' as being mixed and stirred in response to the rotation of the supply roller 14' and screw 15'. Simultaneously a portion of the developer is fed on the surface of the developing sleeve 12' by the supply roller 14', and becomes formed into a magnetic brush on the developing sleeve 12'.

The magnetic brush passes the developer height restricting gap $D_b$ as being cut at its tip by the developer height restricting member 19' in response to the rotation of the developing sleeve 12' and is sent to the developing area X' successively. Then the magnetic brush contacts to the surface of the photosensitive drum 1 at some constant width and sets the electrostatic latent image thereon in the state possible to be developed.

When the scanner 40 is started to operate in the direction indicated by the arrow "b", the light reflected from the original S placed on the original table glass 9 is projected onto the photosensitive drum 1 from the exposure point W through the lenses and mirrors to form the electrostatic latent image corresponding to the original image. The electrostatic latent image is first started to be developed by the second developing device 5.

Then, when the second reed switch 112 provided on the scanner 40 reaches under the magnet 108 of the black-end lever 107, a signal is outputted from the second reed switch 112 to the control unit 70.

At this time, the second developing device motor 24' is continuously driven till the end point $Z_1$ moves to the developing area X' of the second developing device 5 after the electrostatic latent image responsive to the end point $Z_1$ of the area A is formed at the exposure point W. Thus, the second developing motor 24' is off and the second developing solenoid 33' is on after the time $(t_1+t_2)$ from the time the second reed switch 112 has detected the magnet 108, and the second developing device 5 is set in the non-developing state shown in FIGS. 6, 7 as same as the first developing device 4. This time $t_1$ corresponds to a time required for a point on the photosensitive drum 1 to move from the exposure point W to the developing area X of the first developing device 4. The time $t_2$ corresponds to a time required for a point on the photosensitive drum 1 to move from the developing area X to the developing area X' of the second developing device 5.

Until the scanner 50 reaches the lever 103 after passing the lever 107, though the original image responsive to the area D therebetween is exposed on the photosensitive drum 1 to form the electrostatic latent imge as same as the area A, neither of the developing devices 4, 5 is operated with respect to the electrostatic latent image in the area D, so that the original image in the area D is not reproduced.

Next, after the time $t_1$ from the time the first reed switch 111 has detected the magnet 104 of the color-start lever 103, that is, when the electrostatic latent image responsive to the start point $Z_2$ of the area B reaches the developing area X, the first developing motor 24 is on, the first developing solenoid 33 is off in order to start the color developing with respect to the area B.

Then, after the time $t_1$ from the time the first reed switch 111 detected the magnet 106 of the color-end lever 105, the first developing motor 24 is off and the first developing solenoid 33 is on to complete the developing operation till the end point $Z_3$ of the area B. However, until the magnet 110 of the following black-start lever 109 is detected, neither of the developing device 4, 5 is operated with respect to the electrostatic latent image in the area E, so that the image in the area E is not reproduced.

Next, after the time $t_1+t_2$ from the time the second reed switch 112 detected the magnet 110 of the black-start lever 109, that is, when the electrostatic latent image responsive to the start point $Z_4$ of the area C reaches the developing area X', the second developing motor 24' is on and the second developing solenoid 33' is off to start developing operation responsive to the electrostatic latent image in the area C. This state is kept thereafter till a series of copying operations are completed.

By the aforesaid control operation, the image responsive to the areas A, C of the original S is reproduced in black and the image responsive to the area B in color, and the areas D, E between the areas A and B, B and C are non-developed respectively to accomplish two-color copying.

Meanwhile, in the developing operation described above, the image density does not indicate a prescribed value simultaneously at start and stop of the developing devices 4, 5. However as shown in FIG. 10, the image density is shifted to the prescribed density through a build-up area $D_2$ when starting the developing devices 4, 5, conversely it becomes 0 through a build-down area $D_1$, when stopping the developing devices 4, 5. This is because that, among the electrostatic latent images located in the developing areas X, X' at the time point when the develooping devices 4, 5 are started or stopped, the contacting time of the magnetic brush differs between those located on the upstream side and downstream side in the rotating direction of the photosensitive drum 1.

Figure 12:
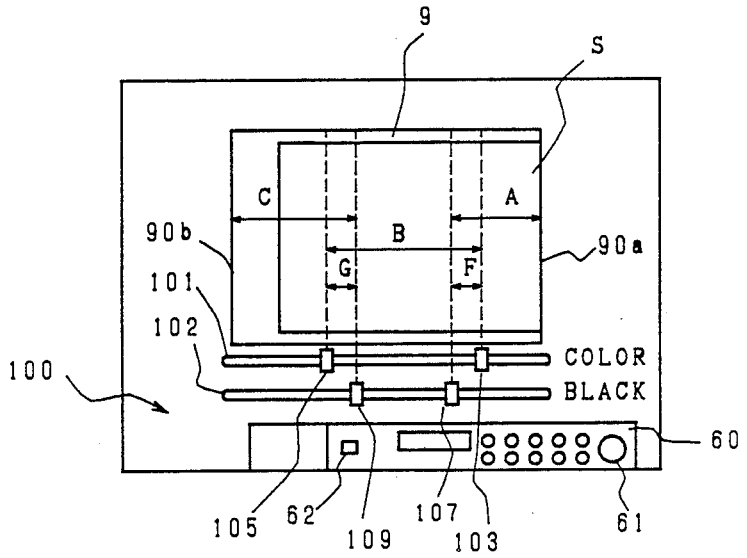
FIG. 12 is a plan view of a two-color copying machine showing another example of an image edition.
Figure 13:
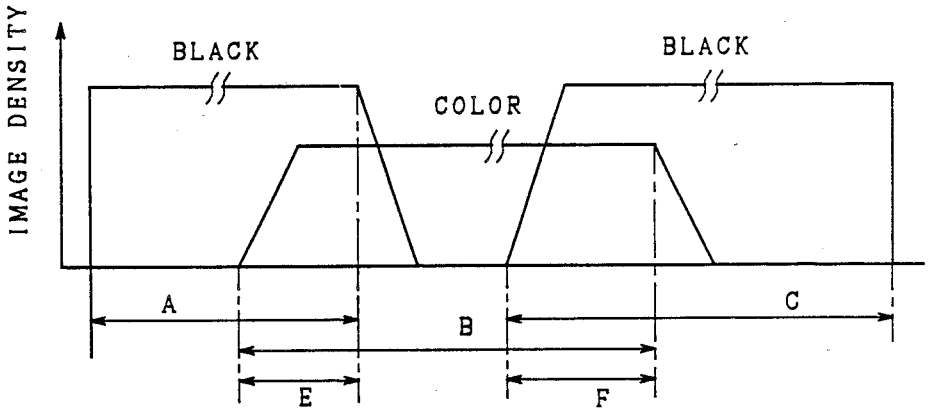
FIG. 13 is a graph showing the state of variation of an image density.

FIG. 12 is a plan view showing another example of an image edition and FIG. 13 is a graph showing the state of variation of an image density thereat, in which both axes are plotted as same as FIG. 10.

Now, though an area between the two adjacent images of different colors is non-developed in the aforesaid embodiment, as shown in FIG. 12, when the black-end lever 107 and black-start lever 109 are positioned respectively between the color-start lever 103 and color-end lever 105, as shown in FIG. 13, a mixed color area F is formed at the overlapping portion of the black area A and color area, B, and similarly a mixed color area G between the color area B and black area C. These mixed color areas F, G can be reproduced in a separate color, in particular, in the state when the color is shifted gradually.

For example, when the red toner is contained in the first developing device 4 and the blue toner in the second developing device 5, the image 1 in the mixed color areas F, G is reproduced respectively in purple.

Now, the second embodiment will be described.

Figure 14:
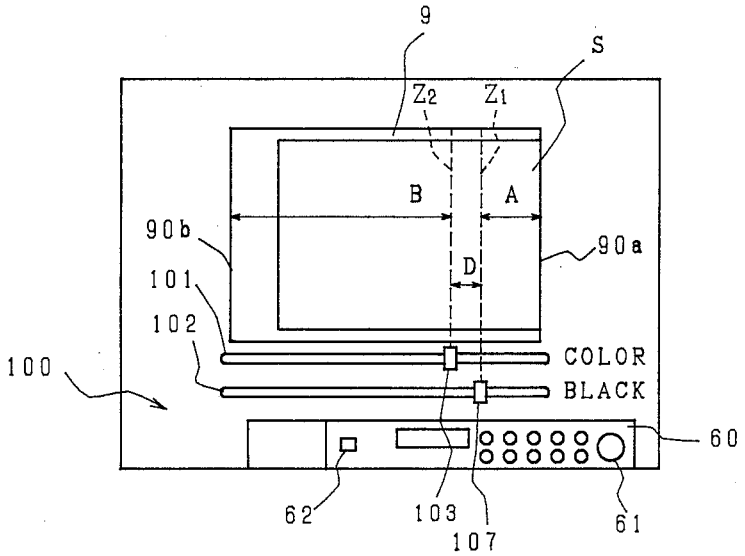
FIG. 14 is a plan view of a two-color copying machine showing an example of an image edition of the second embodiment.
Figure 15:
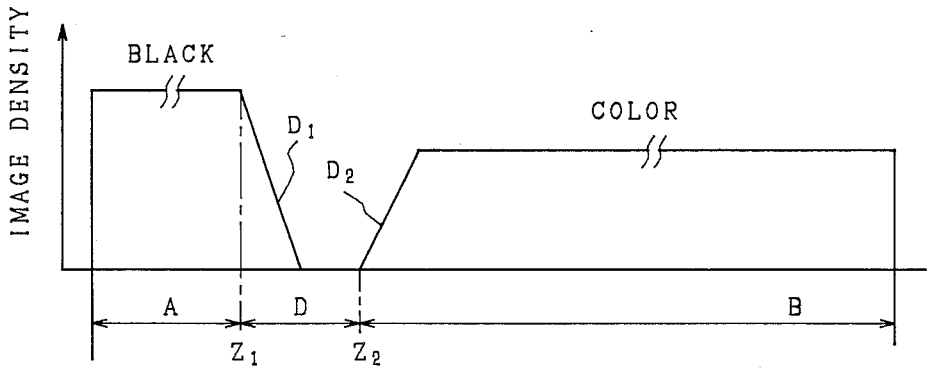
FIG. 15 is a graph showing the state of variation of an image density in the second embodiment.

FIG. 14 is a plan view of a two-color copying machine showing an example of an image edition of the second embodiment, and FIG. 15 is a graph showing the state of variation of an image density thereat.

In FIG. 14, guide grooves 101, 102 of the image editing mechanism 100 are formed in front of the original table glass 9 in parallel thereto. The color-start lever 103 is disposed in the guide groove 101 along the groove movably, and the black-end lever 107 in the guide groove 102 in the same fashion. The magnets 104, 108 are mounted under the levers 103, 107 within the copying machine body, as shown in FIG. 1. While, on the scanner 40 in the optical system 3, the first reed switch 111 and second reed switch 112 are disposed. By scanning the scanner 40 in a direction indicated by an arrow "b", the first reed switch 111 detects the magnet 104 and the second reed switch 112 detects the magnet 108 to output signals respectively to the control unit 70. For example, when the levers 103, 107 are set as shown in FIG. 14, the area A between the front end 90*a* of the original table glass 9 and the black-end lever 107 is designated as the black area, the area B between the color-start lever 103 and the rear end 90*b* of the original table glass 9 as the color area and the area D between the black-end lever 107 and the color-start lever 103 as the non-developing area.

Next, the third embodiment will be explained.

Figure 16:
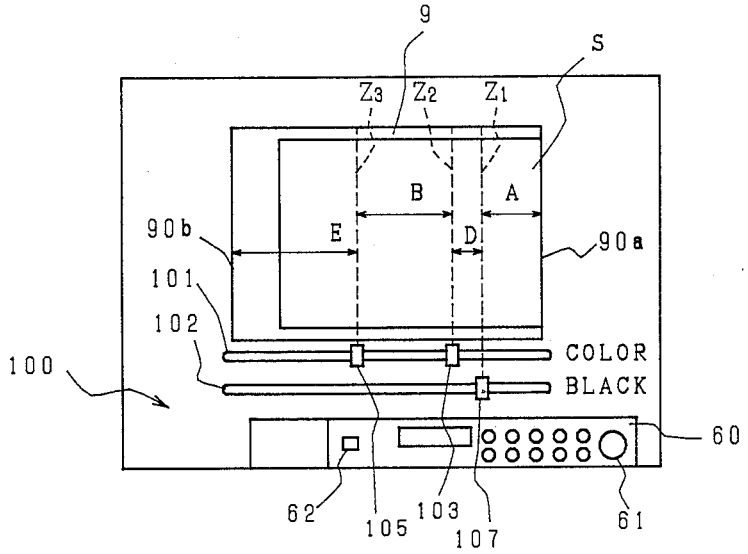
FIG. 16 is a plan view of a two-color copying machine showing an example of an image edition of the third embodiment.
Figure 17:
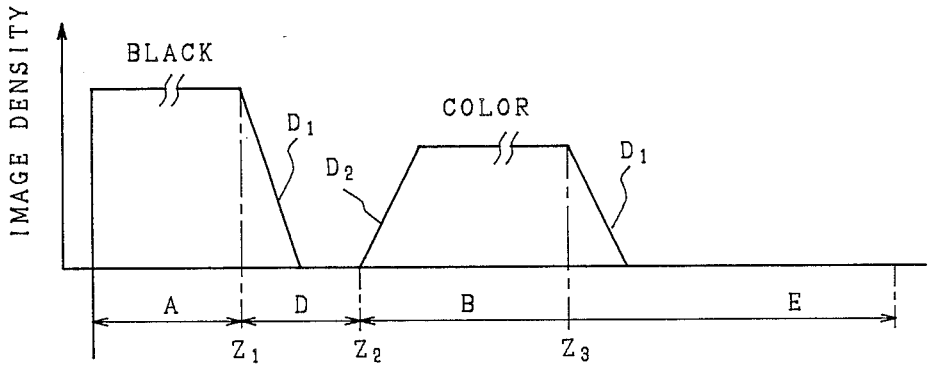
FIG. 17 is a graph showing the state of variation of an image density in the third embodiment.

FIG. 16 is a plan view of a two-color copying machine showing an example of an image edition of the third embodiment, and FIG. 17 is a graph showing the state of variation of an image density thereat.

In FIG. 16, guide grooves 101, 102 of the image editing mechanism 100 are formed in front of the original table glass 9 in parallel thereto. The color-start lever 103 and color-end lever 105 are disposed in the guide groove 101 along the groove movably, and the black-end lever 107 in the guide groove 102 in the same fashion. The magnets 104, 106, 108 are mounted respectively under the levers 103, 105, 107 within the copying machine body, as shown in FIG. 1. While, on the scanner 40 in the optical system 3, the first reed switch 111 and second reed switch 112 are disposed. By scanning the scanner 40 in the direction shown by the arrow "b", the first reed switch 111 detects the magnets 104, 106 and the second reed switch 112 detects the magnet 108 to output the signals respectively to the control unit 70. For example, when the levers 103 to 107 are set as shown in FIG. 16, the area A between the front end 90*a* of the original table glass 9 and the black-end lever 107 is designated as the black area, the area B between the color-start lever 103 and the color-end lever 105 as the color area, the area D between the black-end lever 107 and the color-start lever 103 and the area E between the color-end lever 105 and the rear end 90*b* of the original table glass 9 as the non-developing area.

Next, the fourth embodiment will be explained.

Figure 18:
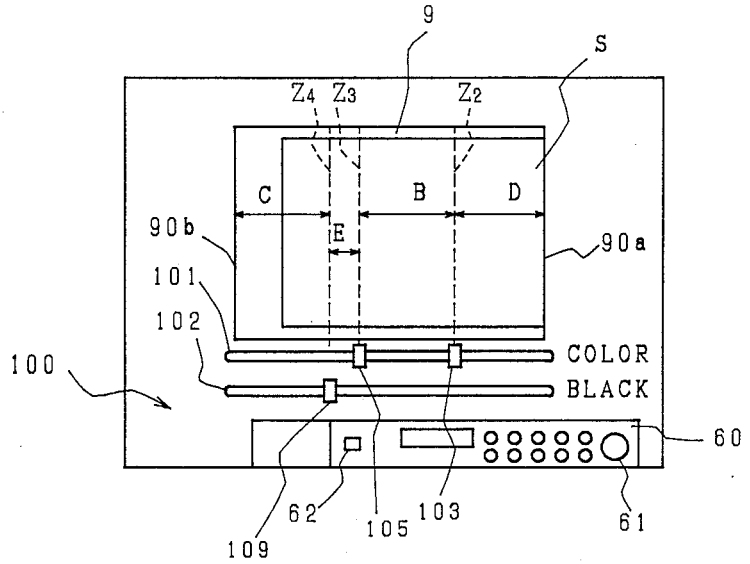
FIG. 18 is a plan view of a two-color copying machine showing an example of an image edition of the fourth embodiment.
Figure 19:
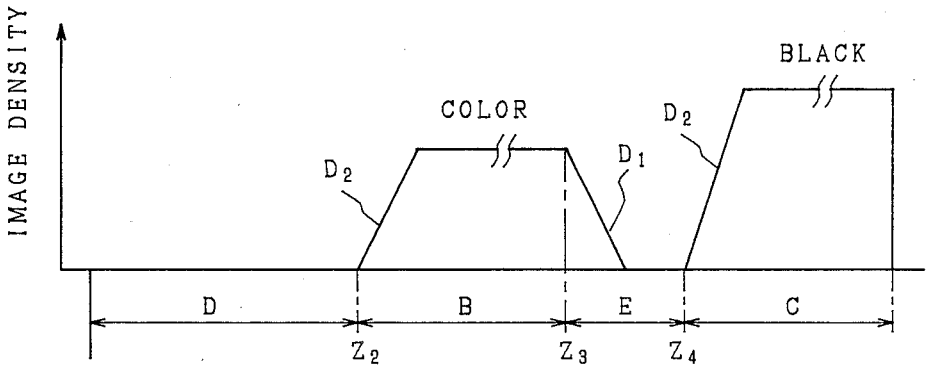
FIG. 19 is a graph showing the state of variation of image density in the fourth embodiment.

FIG. 18 is a plan view of a two-color copying machine showing an example of an image edition of the fourth embodiment, and FIG. 19 is a graph showing the state of variation of an image density thereat.

In the fourth embodiment, a significant difference from the aforesaid three embodiments is that the second developing device 5 is not operated even the print button 61 is pressed.

In FIG. 18, guide grooves 101, 102 of the image editing mechanism 100 are formed in front of the original table glass 9 in parallel thereto. The color start lever 103 and color-end lever 105 are disposed in the guide groove 101 along the groove movably, and the black-start lever 109 in the groove 102 in the same fashion. The magnets 104, 106, 110 are mounted respectively under the levers 103, 105, 109 within the copying machine body, as shown in FIG. 1. While, on the scanner 40 in the optical system 3, the first reed switch 111 and second reed switch 112 are disposed. By scanning the scanner 40 in the direction indicated by the arrow "b", the first reed switch 111 detects the magnets 104, 106 and the second reed switch 112 detects the magnet 110 to output the signals respectively to the control unit 70. For example, when the levers 103 to 109 are set as shown in FIG. 8, the area C between the black-start lever 109 and the rear end 90*b* of the original table glass 9 is designated as the black area, the area B between the color-start lever 104 and the color-end lever 105 as the color area, the area D between the front end 90*a* of the original table glass 9 and the color-start lever 103 and the area E between the color-end lever 105 and the black-start lever 109 as the non-developing area.

Operations of the second to fourth embodiments are same as the first embodiment, so that their explanations will be omitted.

Also in the second to fourthembodiments, the mixed-color area can be designated by setting each lever as same as the first embodiment.

Moreover, though the two developing devices are used in the above four embodiments, the present invention is not limited thereto. The numbers of levers of the image editing mechanism may just be decided responsive to the number of developing devices when two or more developing devices are used.

As it will be apparent from the explanation made heretofore, in the multiple color image forming apparatus having the 1-shot 2-color copying function indicated in this invention, start and end points of the area are set responsive to a plurality of developing devices, and by controlling the operation of the developing devices with respect to the set area, the image area can be set freely according to the purpose of use and preference. Also the non-imaged area or mixed-color area can be formed by providing a blank between the areas to erase information thereof or overlapping the areas with each other. In particular, by selecting colors of the developer suitably, the image can be reproduced in a third color different from the colors of developer contained, for example, the three-color image may be obtained by using the two-color developer.

As this invention may be embodied in several forms without departing from the spirit of essential characteristics thereof, the present embodiment is therefore illustrative and not restrictive; since the scope of the invention is defined by the appended claims rather than by the description preceding them, and all changes that fall within the meets and bounds of the claims, or equivalence of such meets and bounds thereof are therefore intended to be embraced by the claims.

What is claimed is:

1. A multiple color image forming comprising, an original table on which an original is placed;

a photosensitive drum which is rotatable;

a scanning means for scanning the original on said original table from the scanning start position to the end position; P1 an image processing means for projecting the original image scanned by said scanning means to said photosensitive drum to form an electrostatic latent image thereon;

first and second developing means for developing the electrostatic latent image on said photosensitive drum by a toner having different colors respectively;

a copying start command input means for inputting the copying start command;

means for starting said scanning means, image processing means and first developing means in response to said copying start command; 'first and second position indicating means for being movable in the scanning direction of said scanning means between said scanning start position and scanning end position along the original table;

a first detecting signal output means for detecting said scanning means arrived at a position responsive to said first position indicating means during the scanning and outputting the first detecting signal;

a first control means for stopping the first developing means in response to said first detecting signal;

a second detecting signal output means for detecting said scanning means arrived at a position responsive to said second position indicating means during said scanning and outputting the second detecting signal; and a second control means for starting the second developing means in response to said second detecting signal.

2. A multiple color image forming apparatus as set forth in claim 1, wherein said first and second position indicating means are movable on two passages disposed separately respectively.

3. A multiple color image forming apparatus as set forth in claim 1, further comprising a multiple-color mode setting means for being set before inputting said copying start command to set a multiple-color mode wherein a multiple-color image is formed during one scanning.

4. A multiple color image forming apparatus as set forth in claim 3, wherein said first control means stops the first developing means responsive to said first detecting signal when said multiple-color mode is set by said multiple-color mode setting means.

5. A multiple color image forming apparatus as set forth in claim 3, wherein said second control means starts the second developing means responsive to said second detecting signal when said multiple-color mode is set by said multiple-color mode setting means.

6. A multiple color image forming apparatus comprising, an original table on which an original is placed;

a photosensitive drum which is rotatable;

a scanning means for scanning the original on said original table from the scanning start position to the end position;

an image processing means for projecting the original image scanned by said scanning means to the photosensitive drum to form an electrostatic latent image thereon; P1 first and second developing means for developing the electrostatic latent image on said photosensitive drum by a toner having different colors respectively;

a copying start command input means for inputting the copying start command;

means for starting said scanning means, image processing means and first developing means in response to said copying start command;

first, second, third and fourth position indicating means for being movable in the scanning direction of said scanning means between the scanning start position and scanning end position along the original table;

a first detecting signal output means for detecting said scanning means arrived at a position responsive to said first position indicating means during the scanning and outputting the first detecting signal;

a first control means for stopping the first developing means in response to said first detecting signal;

a second detecting signal output means for detecting said scanning means arrived at a position responsive to said second position indicating means during said scanning and outputting the second detecting signal;

a second control means for starting the second developing means in response to said second detecting signal;

a third detecting signal output means for detecting said scanning means arrived at a position responsive to said third position indicating means during said scanning and outputting the third detecting signal;

a third control means for stopping the second developing means in response to said third detecting signal;

a fourth detecting signal output means for detecting said scanning means arrived at a position responsive to said fourth position indicating means during said scanning and outputting the fourth detecting signal; and a fourth control means for starting the first developing means in response to said fourth detecting signal.

7. A multiple color image forming apparatus as set forth in claim 6, wherein said first and fourth indicating means and second and third indicating means are movable on two passages disposed separately respectively.

8. A multiple color image forming apparatus as set forth in claim 6, further comprising a multiple-color mode setting means for being set before inputting said copying start command to set a multiple-color mode wherein a multiple-color image is formed during one scanning.

9. A multiple color image forming apparatus as set forth in claim 8, wherein said first control means stops the first developing means responsive to said first detecting signal when said multiple-color mode is set by said multiple-color mode setting means.

10. A multiple color image forming apparatus as set forth in claim 8, wherein said second control means starts the second developing means responsive to said second detecting signal when said multiple-color mode is set by said multiple-color mode setting means.

11. A multiple color image forming apparatus as set forth in claim 8, wherein said third control means stops the second developing means responsive to said third detecting signal when said multiple-color mode is set by said multiple-color mode setting means.

12. A multiple color image forming apparatus as set forth in claim 8, wherein said fourth control means starts the first developing means responsive to said fourth detecting signal when said multiple-color mode is set by said multiple-color mode setting means.

13. A multiple color image forming apparatus comprising, an original table on which an original is placed;

a photosensitive drum which is rotatable;

a scanning means for scanning the original on said original table from the scanning start position to the end position;

an image processing means for projecting the original image scanned by said scanning means to the photosensitive drum to form an electrostatic latent image thereon;

first and second developing means for developing the electrostatic latent image on said photosensitive drum by a toner having different colors respectively;

a copying start command input means for inputting the copying start command;

means for starting said scanning means, image processing means and first developing means in response to said copying start command;

first, second and third position indicating means for being movable in the scanning direction of said scanning means between the scanning start position and scaning end position along the original table;

a first detecting signal output means for detecting said scanning means arrived at a position responsive to said first position indicating means during the scanning and outputting the first detecting signal;

a first control means for stopping the first developing means in response to said first detecting signal;

a second detecting signal output means for detecting said scanning means arrived at a positon responsive to said second position indicating means during said scanning and outputting the second detecting signal;

a second control means for starting the second developing means in respone to said second detecting signal;

a third detecting signal output means for detecting said scanning means arrived at a position responsive to said third position indicating means during said scanning and outputting the third detecting signal; and a third control means for stopping the second developing means in response to said third detecting signal.

14. A multiple color image forming apparatus comprising, an original table on which an original is placed;

a photosensitive drum which is rotatable;

a scanning means for scanning the original on said original table from the scanning start position to the end position;

an image processing means for projecting the original image scanned by said scanning means to the photosensitive drum to form an electrodstatic latent image thereon;

first and second developing means for developing the electrostatic latent image on said photosensitive drum by a toner having different colors respectively;

a copying start command input means for inputting the copying start command;

means for starting said scanning means and image processing means in response to said copying start command;

first, second and third position indicating means for being movable in the scanning direction of said scanning means between the scanning start position and scanning end position along the original table;

a first detecting signal output means for detecting said scanning means arrived at a position responsive to said first position indicating means during the scanning and outputting the first detecting signal;

a first control means for starting the first developing means in response to said first detecting signal;

a second detecting signal output means for detecting said scanning means arrived at a position responsive to said second position indicating means during said scanning and outputting the second detecting signal;

a second control means for stopping the first developing means in response to said second detecting signal;

a third detecting signal output means for detecting said scanning means arrived at a position responsive to said third position indicating means during said scanning and outputting the third detecting signal; and a third control means for starting the second developing means in response to said third detecting signal.

* * * * *